United States Patent [19]

Taguchi et al.

[11] Patent Number: 5,074,441

[45] Date of Patent: Dec. 24, 1991

[54] LIQUID CONTAINER CLOSURE LOCKABLE IN THE OPEN POSITION

[75] Inventors: Akihiro Taguchi; Kuniyasu Obara, both of Tokyo, Japan

[73] Assignee: Toppan Printing Co., Ltd., Japan

[21] Appl. No.: 411,868

[22] Filed: Sep. 25, 1989

[30] Foreign Application Priority Data

Sep. 26, 1988 [JP] Japan ..... 63-125366[U]

[51] Int. Cl.[5] ..... B65D 47/00

[52] U.S. Cl. ..... 222/517; 222/556; 251/89

[58] Field of Search ..... 222/511, 517, 546, 153, 222/556, 501, 563, 498, 505; 251/89, 90, 91

[56] References Cited

U.S. PATENT DOCUMENTS

| | | | |
|---|---|---|---|
| 3,400,866 | 9/1986 | Fattori . | |
| 3,972,452 | 8/1976 | Welsh | 222/501 |
| 4,444,340 | 4/1984 | Bond et al. | 222/517 X |
| 4,623,077 | 11/1986 | Swartzbaugh | 222/517 |
| 4,905,875 | 3/1990 | Straiton | 222/505 |

FOREIGN PATENT DOCUMENTS

| | | |
|---|---|---|
| 56-138093 | 10/1981 | Japan . |
| 55-56294 | 11/1988 | Japan . |
| 55-021709 | 2/1990 | Japan . |

*Primary Examiner*—Kevin P. Shaver

*Attorney, Agent, or Firm*—Ostrolenk, Faber, Gerb & Soffen

[57] ABSTRACT

A closure of a liquid container, such as plastic bottles or chemical bottles, has a cap made of a resilient material and provided with a central opening-and-closing protrusion erected. By fitting a stopper of a relatively hard material onto the cap and provided with an engagement part onto the cap, the contents of the container can be poured and kept at its pouring or dispensing condition after the protrusion is rotated and engaged or hooked with the engagement part by a thumb and finger of the operator or user of the bottle. It is easy to release the hooked or engaged condition of the protrusion of the cap to the lever of the stopper, permitting the contents to be stopped from dispensing instantly.

7 Claims, 5 Drawing Sheets

LIQUID CONTAINER CLOSURE LOCKABLE IN THE OPEN POSITION

BACKGROUND OF THE INVENTION (1) Field of the Invention

This invention relates to a cap or closure to a dispenser tap of a liquid container and more particularly to a cap for a disposable liquid container comprised of an inner bag made of plastic film and an outer box made of corrugated cardboard and the like.

(2) Description of the Prior Art

Nowadays, a variety of liquid containers for drinks such as juice, wine and the like and chemical agents such as photographic developer have been made of a plastic-made inner bag and a corrugated cardboard outer box described above. One of the conventional structure of such dispenser closure adapted to the liquid containers is described in, for example, U.S. Pat. No. 3,400,866 disclosing an inner bag (a), a cap (e) having a resilient and concaved wall (d), and a cylindrical spout (c) thermally adhered to an opening (b) of the inner bag (a). In order to use or dispense the contents of the liquid container, a thumb and a finger rotate or push a protrusion (f) erected from the resilient wall (d) by a fixed or suitable degree and delivery mouth (g) is formed between the top end of the cylindrical spout (c) and the concaved wall (d), flowing the contents out of the container.

It is noted that the liquid flowing or dispensing from the conventional container above is effective or continued only in the time the protrusion (f) of the cap (e) rotates and is held at an inclined condition, so that it is necessary to use the thumb and finger of the operator in order to hold the protrusion at an inclined condition. Furthermore, it is necessary to the operator to give a continuous force of a degree stronger than the backward resilient force of the concaved wall (d) and the cap (e) to the protrusion, so that the conventional dispenser closing system doesn't function effectively when the operator or user of the container is a child or female.

SUMMARY OF THE INVENTION

Accordingly it is an object of the present invention to provide a liquid container closure overcoming the disadvantages mentioned above of the prior art, which closure includes a cap applied to a ring-like spout adhered to or integrally formed with a liquid container. The cap includes a cylindrical wall, a flowing outlet formed in a part of the cylindrical wall, and a concaved wall so formed as to freely deform and has a central portion and an opening-closing protrusion projected from the central portion. The central portion is adapted to resiliently contact with the opening of the ring-like spout. The concaved wall is integrally formed with or extended to the cylindrical wall. A separate stopper is fitted onto the cap. The stopper has a ring portion to fit into the ring-like wall, an engagement portion connected to the ring portion through a horizontal wall so as to engage with the opening-closing protrusion during a flowing of contents, and a lever used to release the opening-closing protrusion and formed at the position opposing the engagement portion.

In operation of the liquid container closure, the opening-closing protrusion of the cap rotates by a finger of the operator and the top end of the protrusion engages with the engagement portion of the stopper made of a relatively stiff material in order to keep the flowing outlet in its open condition. The engagement can be released easily by revolving the lever having the engagement portion.

DETAILED DESCRIPTION OF THE INVENTION

Figure 1:
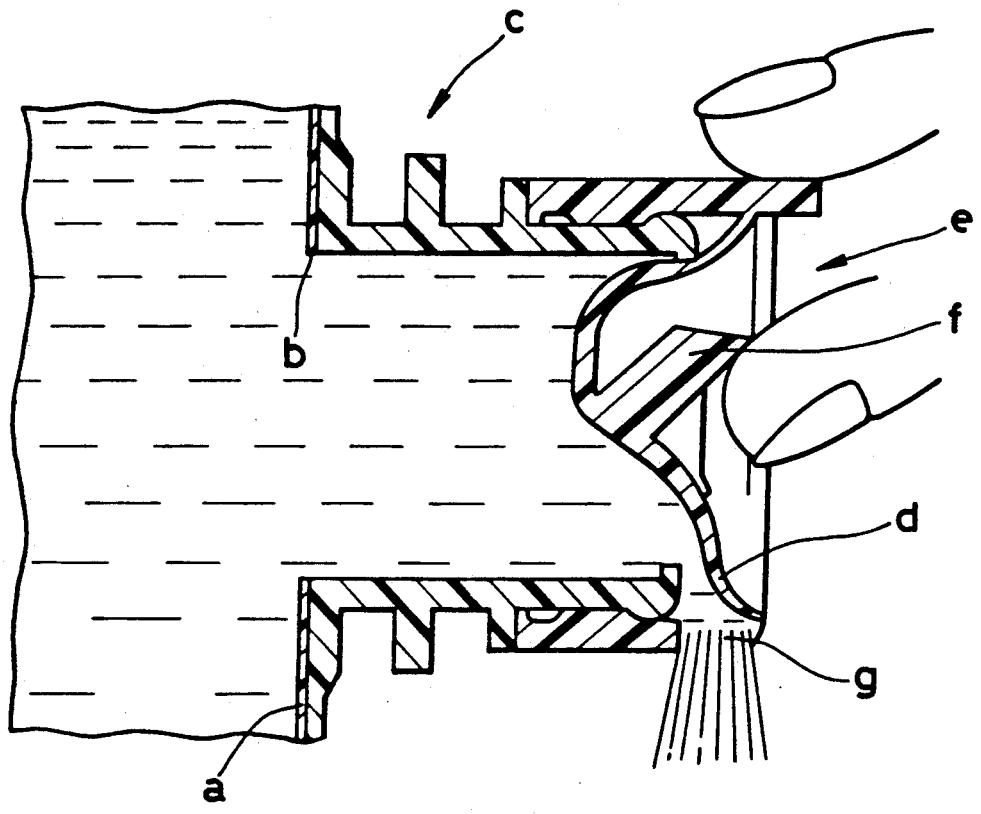
FIG. 1 (PRIOR ART)
FIG. 1 shows a transversal sectional view of the conventional tap dispenser closure of the prior art.
Figure 2:
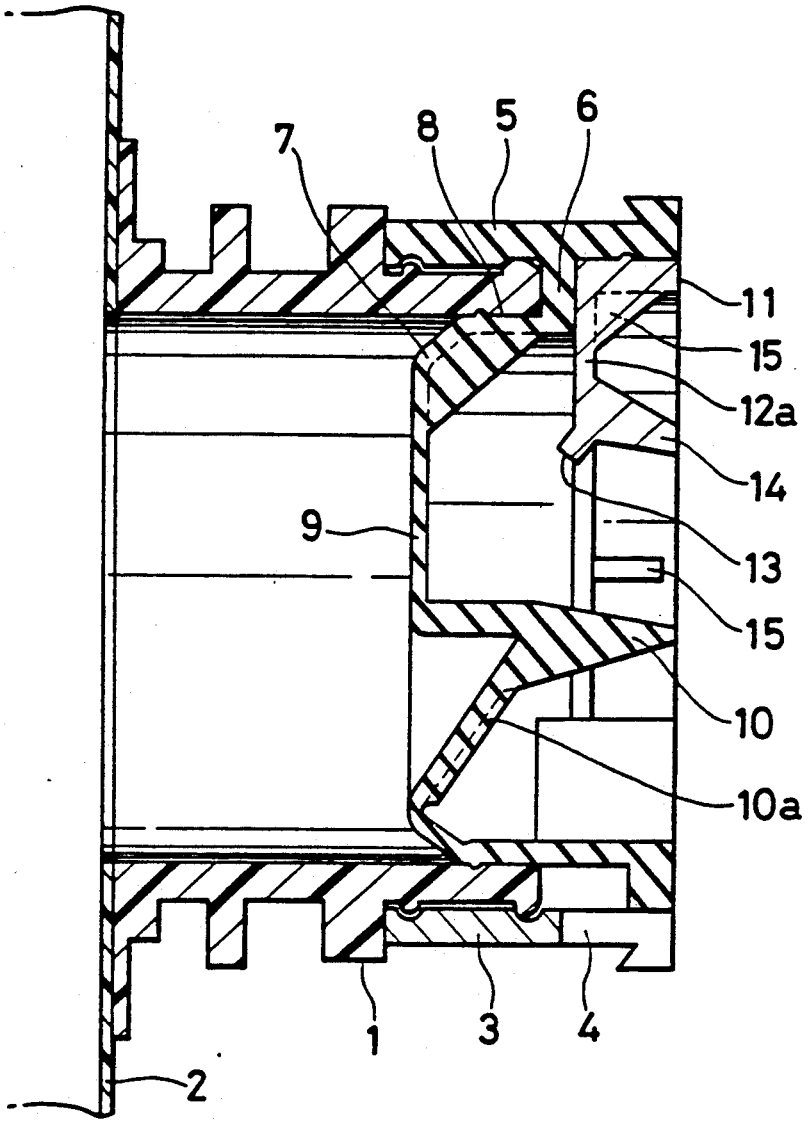
FIG. 2 shows a sectional view taken along a line A—A in FIG. 3 of the liquid container closure according to the present invention.
Figure 3:
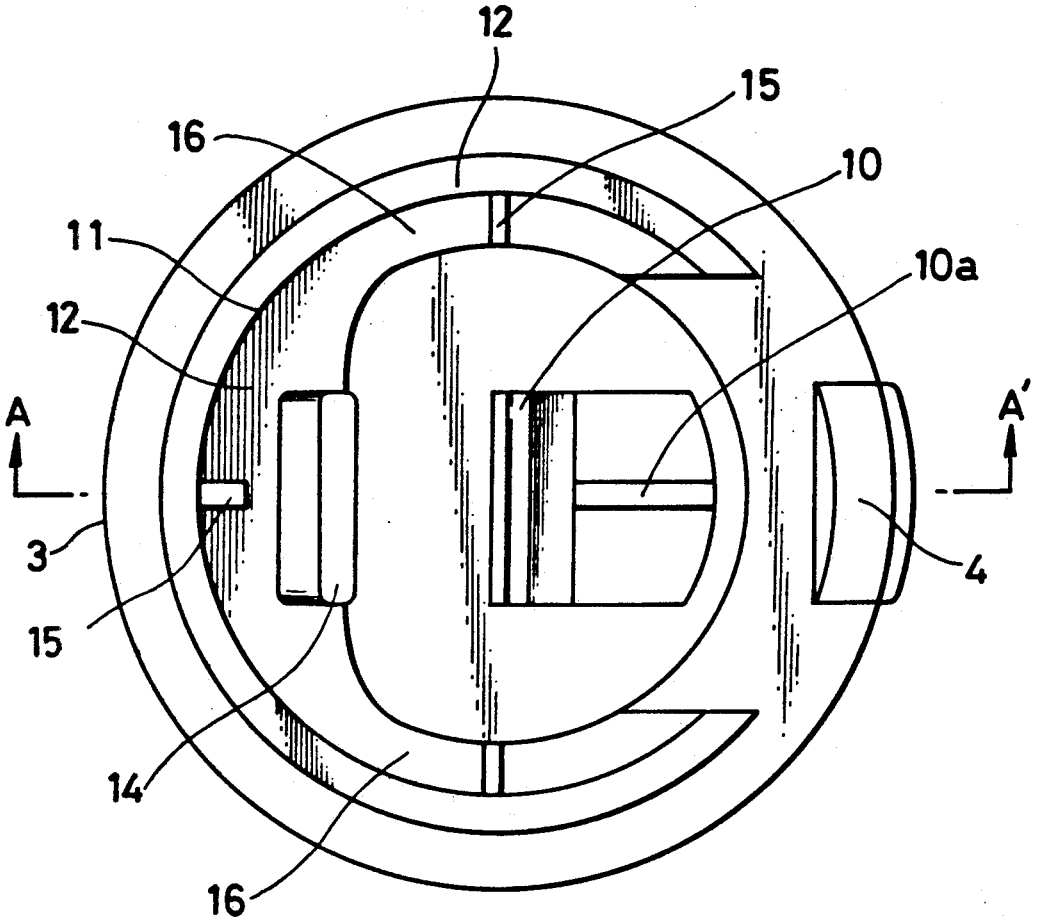
FIG. 3 is a plan view of the liquid container closure.

The preferred embodiment of the present invention will be described with reference to the drawings, in which FIG. 1 depicts a conventional tap closure of liquid containers and FIGS. 2–5 shows a tap closure of a liquid container according to the present invention. Referring now to FIG. 2, a ring-like spout (1) formed in a liquid container (2) has a shape of a cylinder. The front outlet of the cylindrical spout (1) leads to the interior of the liquid container (2), permitting the contents to flow through the front outlet. The cap (3) is formed of resilient material, such as polyester, polypropyrene or synthetic rubber. The cylindrical spout (1) is manufactured of semi-hard plastics, such as polyethylene, polyvinyl chloride or the like. The cap (3) and the cylindrical spout (1) are connected by an ordinary fitting method as shown in FIG. 2 or by a threading method. The upper side portion of the cap (3) has a flowing outlet (4) protruding therefrom. It is noted that the cap (3) has a cylindrical wall (5) and a concaved wall (7) downwardly concaved and connected to the vertical mid portion of the cylindrical wall (5) through a ring-like or circular stepped wall (6). The concaved wall (7) is made of a thin resilient material. As shown the concaved wall (7) is adapted to contact with the inner wall of the opening (8) of the cylindrical spout (1) in its ordinary condition after applying into the opening (8), preventing the contents from leading out of the container. An opening-closing protrusion (10) is integrally formed at about the center of the bottom wall portion (9) of the concaved wall (7) so as to extend in parallel with the direction of the flowing outlet (4). A rib (10*a*) connecting the protrusion (10) and the erected outside wall of the cap (3) keeps the protrusion (10) at its erected or vertical position, in which the outer wall of the concaved wall (7) firmly contacts with the inner wall of the spout (1).

Figure 4:
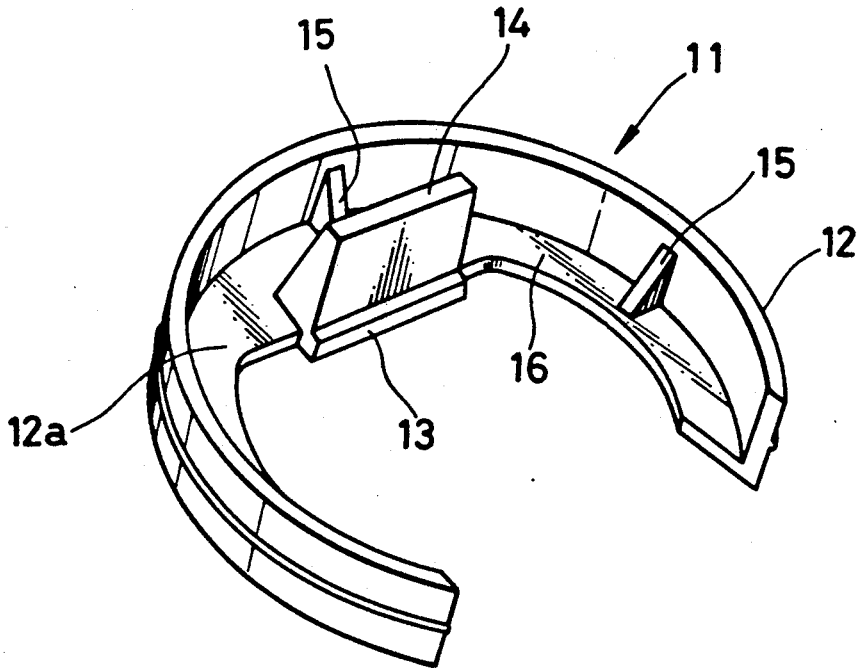
FIG. 4 is a perspective view of the stopper of the present invention.

A stopper (11) shown in FIG. 4 is additionally applied or fitted onto the cap (3). The stopper (11) has a ring part (12) provided with a cut-off portion, which is fitted into the space within the ring-like upper portion of the cylindrical wall (5), a horizontal wall (12*a*) shaped in an arc or semi-circular and formed at the inner wall edge of the ring portion (12) and a lever (14) situated at the chord portion of the arc horizontal wall (12*a*). The lever (14) is erected slantedly and upwardly from the chord portion and has an engagement portion (13) protruding slantedly and downwardly. Three reinforcing ribs (15) are mounted on reinforcing horizontal walls (16) extending from the horizontal wall (12*a*). As described previously the stopper (11) is fitted onto the top of the cap (3) and the stopper (11) is apt to rise and be dropped out of the cap when a revolving force is applied to the lever (14). Accordingly, it may be possible to provide reinforcing ribs (not shown) at the outer wall of the ring part (12).

Figure 5:
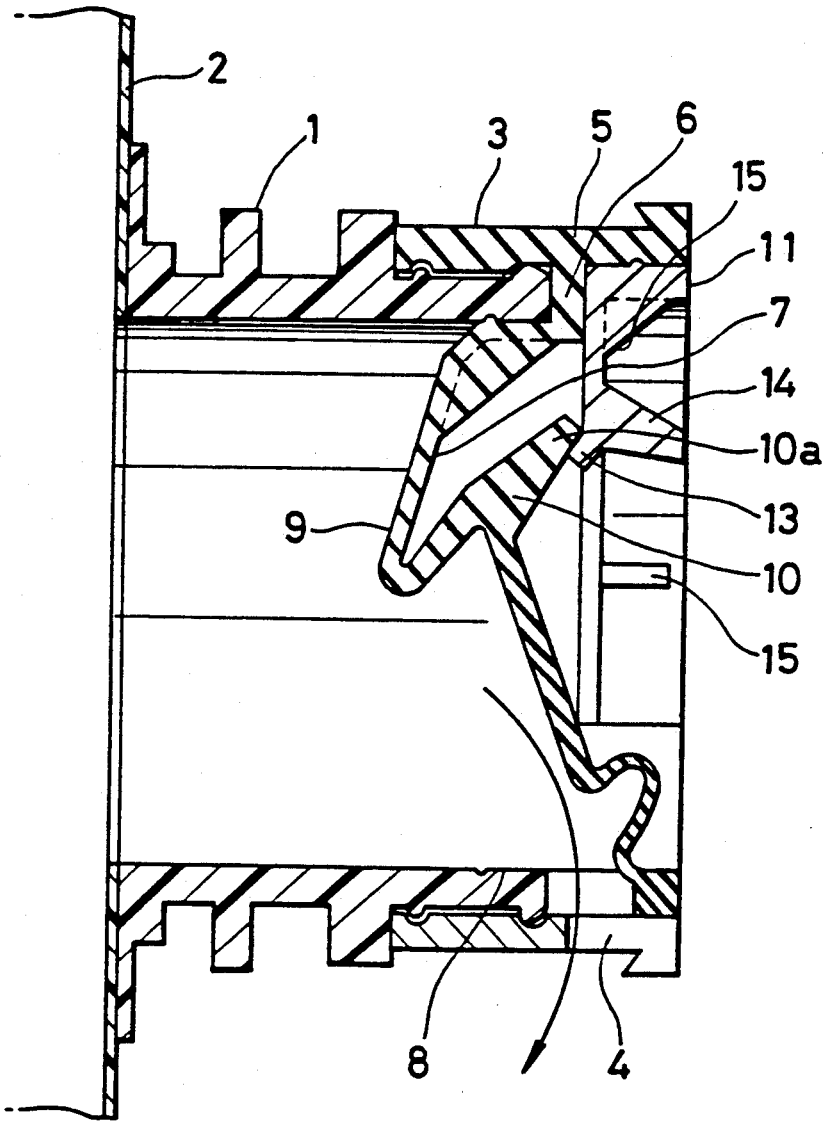
FIG. 5 is a sectional view similar to FIG. 2, depicting the liquid container closure in its open condition.

Next, use of the liquid container closure of the present invention will be described. In general, when the liquid container is used to dispense the contents thereof, the flowing outlet (4) is faced downwardly as shown in FIG. 5. When the opening and closing protrusion (10) erected from the concaved wall (7) is rotated upwardly as shown separating from the outlet (4), the wall portion of the cylindrical wall of the concaved wall (7) is deformed and separated from the open portion (8) of the ring-like spout (1), permitting the contents to flow through the open portion (8) and the flowing outlet (4).

It is noted that the liquid container closure of the present invention is suitable in particular to enable a high volume of the contents to flow from the container. That is, the particular construction of the protrusion (10) and the engagement part (13) of the liquid container closure make such high flow possible. If the opening and closing protrusion (10) can not rotate at its maximum and it is not engaged with the engagement part (13) formed on the lever (14), the resilient concaved wall (7) will return to its original position when the pressing finger is released. In returning to its original position, the cylindrical wall portion of the concaved wall (7) contacts with the inner wall of the spout (1), stopping the flowing of the contents. However, according to the present invention, the protrusion (10) can sufficiently rotates and engages with the engagement part (13), keeping as a result the flowing outlet (4) at its open condition for a considerable length of time.

Then, one of reinforcing ribs (15) is provided over the lever (14) so that the concaved wall (7) may be prevented from deforming outwardly and the protrusion (10) may not be put out of engagement with the engagement part (13)

When it is intended to stop the contents flowing out of the liquid container, the lever (14) extending oppositely from the engagement part (13) is pushed or rotated and the part (13) disengages from the end portion of the opening-and-closing protrusion (10) utilizing the principles of the lever and fulcrum. Consequently, resiliency of the bottom wall (9) and the cylindrical wall portion makes the cylindrical wall portion contact with the inner wall or opening (8) of the spout (1).

It is easily understood from the above description that the present invention contemplates a liquid container closure for suitably dispensing the contents, by which closure it is not necessary to keep the opening-and-closing protrusion at its levered-up condition. This makes it possible for women and children to use the closure at will without difficulty when they want to start and stop pouring of the contents. The above practical characteristics can be obtained by merety the constructional addition of the stopper to the cap of a conventional type.

Although only one embodiment of the invention has been disclosed and described, it is apparent that other embodiments and modifications of the invention are possible within the scope of claims shown below.

We claim:

1. A liquid container closure comprising a cap to be applied to a ring-like spout of a container and a stopper to be applied to the top portion of said cap, wherein said cap is made of a first resilient material and has a cylindrical wall portion, a flowing outlet formed as a part of said cylindrical wall portion, and a resilient and deformable concaved wall portion connected integrally with the cylindrical wall portion so as to resiliently contact and snugly fit into the opening of said ring-like spout, said concaved wall portion has an opening-and-closing protrusion at its center, and said stopper is made of a second relatively hard material and includes a ring portion fitted into the cylindrical wall portion of said cap, an engagement part to be engaged with said opening-and-closing protrusion during a flowing-out period and connected to said ring portion through a horizontal wall, and a lever formed at the opposed position from the engagement part, said stopper being formed separate and apart from said cap.

2. The liquid container closure according to claim 1, wherein said cylindrical wall portion and the concaved wall portion, respectively of the cap are connected through a circular stepped wall of a length substantially the same as the thickness of the cylindrical wall of said spout.

3. The liquid container closure according to claim 1 wherein said container has contents and said opening-and-closing protrusion of the cap has a sufficient strength so as to be kept at its engaged relation with the engagement part of the stopper for at least a flowing-out period sufficient to dispense the contents of the container.

4. The liquid container closure according to claim 1, wherein said lever of the stopper extends slantedly and upwardly, and said engagement part of the stopper extends slantedly and downwardly.

5. The liquid container closure according to claim 2 wherein said container has contents and said opening-and-closing protrusion of the cap has a sufficient strength so as to be kept at its engaged relation with the engagement part of the stopper for at least a flowing-out period sufficient to dispense the contents of the container.

6. The liquid container closure according to claim 2, wherein said lever of the stopper extends slantedly and upwardly, and said engagement part of the stopper extends slantedly and downwardly.

7. The liquid container closure according to claim 3, wherein said lever of the stopper extends slantedly and upwardly, and said engagement part of the stopper extends slantedly and downwardly.

* * * * *